United States Patent [19]

Zushi

[11] 4,454,404

[45] Jun. 12, 1984

[54] HIGH FREQUENCY HEATING APPARATUS WITH SELECTABLE STEAM GENERATING MEANS

[75] Inventor: Sadao Zushi, Fuji, Japan

[73] Assignee: Tokyo Shibaura Denki Kabushiki Kaisha, Kawasaki, Japan

[21] Appl. No.: 324,570

[22] Filed: Nov. 24, 1981

Related U.S. Application Data

[63] Continuation of Ser. No. 37,319, May 9, 1979, abandoned.

[30] Foreign Application Priority Data

May 10, 1978 [JP] Japan ..... 53-54386

[51] Int. Cl.[3] ..... H05B 6/68

[52] U.S. Cl. ..... 219/10.55 B; 219/10.55 R

[58] Field of Search ..... 219/10.55 R, 10.55 B, 219/10.55 M, 10.55 A, 10.55 E

[56] References Cited

U.S. PATENT DOCUMENTS

| | | | |
|---|---|---|---|
| 3,654,417 | 4/1972 | Javes | 219/10.55 R |
| 3,718,082 | 2/1973 | Lipoma | 219/10.55 R |
| 3,854,219 | 12/1974 | Staats | 219/10.55 R |
| 4,045,640 | 8/1977 | McQueen, Jr. et al. | 219/10.55 B |
| 4,129,769 | 12/1978 | Takagi et al. | 219/10.55 B |
| 4,154,861 | 5/1979 | Smith | 219/10.55 M |

FOREIGN PATENT DOCUMENTS

| | | | |
|---|---|---|---|
| 49-34440 | 3/1974 | Japan | 219/10.55 R |
| 52-26284 | 6/1977 | Japan . | |
| 54-9038 | 1/1979 | Japan | 219/10.55 R |
| 622013 | 4/1949 | United Kingdom | 219/10.55 M |
| 1212365 | 11/1970 | United Kingdom. | |
| 1332122 | 10/1973 | United Kingdom. | |
| 1499279 | 1/1978 | United Kingdom. | |
| 1515976 | 6/1978 | United Kingdom. | |
| 1540295 | 2/1978 | United Kingdom. | |

*Primary Examiner*—Roy N. Envall, Jr.
*Assistant Examiner*—M. M. Lateef
*Attorney, Agent, or Firm*—Cushman, Darby & Cushman

[57] ABSTRACT

A high frequency heating apparatus comprises an oven for receiving a food stuff to be cooked, a high frequency generator for supplying high frequency wave to the foodstuff, a steam generator for supplying steam to the foodstuff, and a control circuit. The control circuit operates so as to drive only the selected one of the high frequency generator and the steam generator or to drive first the steam generator and then the high frequency generator.

5 Claims, 22 Drawing Figures

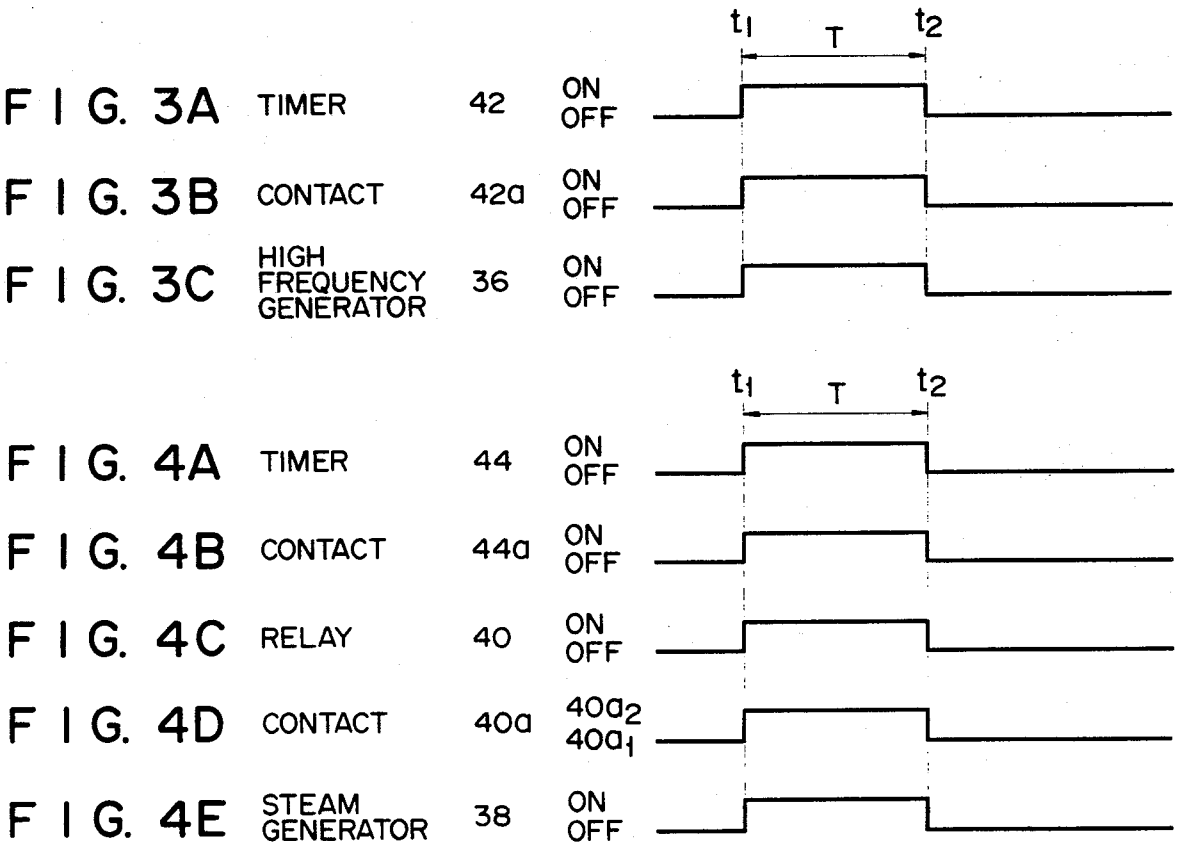
FIG. 3A TIMER 42 ON OFF
FIG. 3B CONTACT 42a ON OFF
FIG. 3C HIGH FREQUENCY GENERATOR 36 ON OFF
FIG. 4A TIMER 44 ON OFF
FIG. 4B CONTACT 44a ON OFF
FIG. 4C RELAY 40 ON OFF
FIG. 4D CONTACT 40a 40a2 40a1
FIG. 4E STEAM GENERATOR 38 ON OFF
t1
T
t2

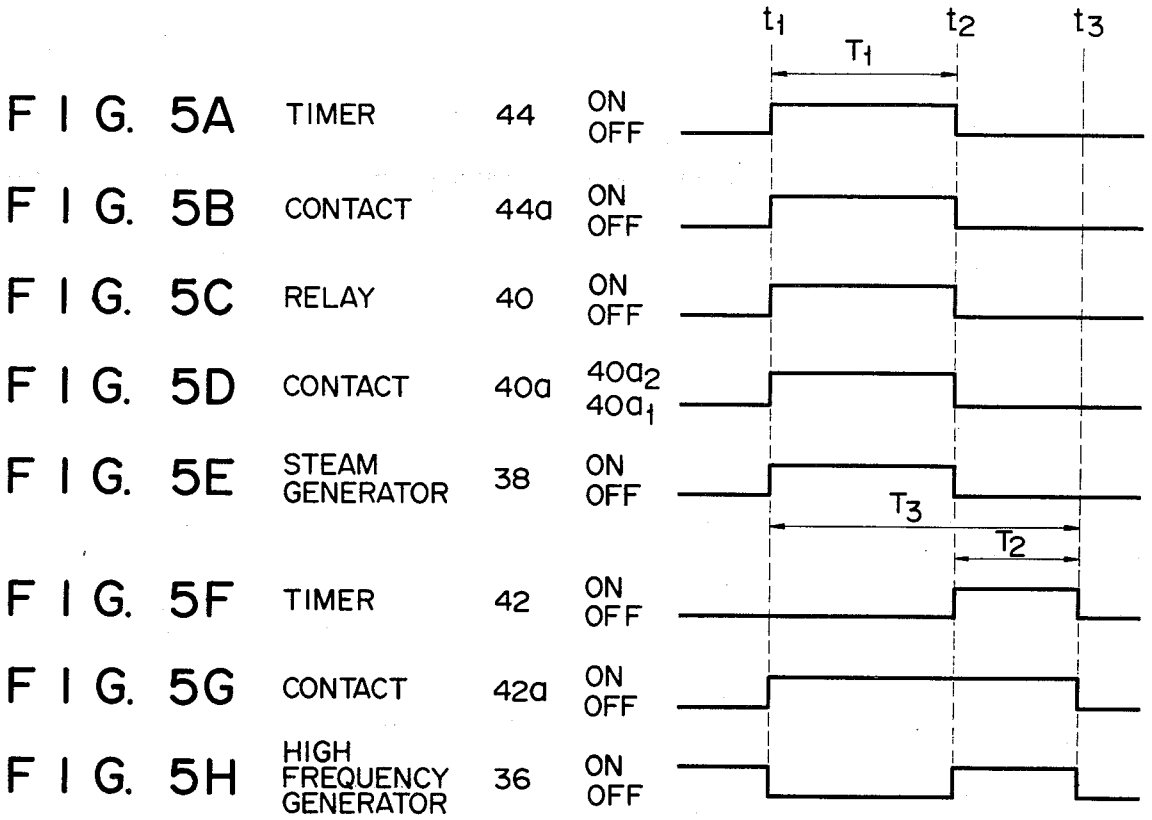
FIG. 5A TIMER 44 ON OFF
FIG. 5B CONTACT 44a ON OFF
FIG. 5C RELAY 40 ON OFF
FIG. 5D CONTACT 40a 40a2 40a1
FIG. 5E STEAM GENERATOR 38 ON OFF
FIG. 5F TIMER 42 ON OFF
FIG. 5G CONTACT 42a ON OFF
FIG. 5H HIGH FREQUENCY GENERATOR 36 ON OFF
t1
t2
t3
T1
T2
T3

HIGH FREQUENCY HEATING APPARATUS WITH SELECTABLE STEAM GENERATING MEANS

This is a continuation of application Ser. No. 37,319 filed May 9, 1979, now abandoned.

This invention relates to a high frequency heating apparatus in which a high frequency generator and a steam generator are operable independently or are sequentially operable in a given order.

A high frequency heating apparatus has been widely used for cooking. Such conventional high frequency heating apparatus indeed has the advantage that it can shorten cooking time. It has the disadvantage, however, that water contained in a foodstuff to be cooked is excessively vaporized to render the cooked food less tasty.

In view of the above circumstance, there has been recently developed a high frequency heating apparatus of the type which comprises not only a high frequency generator but also an electric heater for heating the foodstuff to be cooked.

A heating apparatus of another type is also known which utilizes steams to heat a foodstuff for cooking. The apparatus generally comprises an electric heater as a heat source for producing steams. The heating apparatus generally uses the heat produced by the electric heater not only for heating water contained in a steam generator, but also for heating the foodstuff to be cooked.

A relatively long time is needed to cook using the steam heating alone, when the steam heating is highly required for cooking various foodstuffs. Application of both the heat of the electric heater and the steam of the steam generator, namely, initial application of the former and subsequent application of the latter, would result in an increase in the cooking time.

Accordingly, an object of the invention is to provide a high frequency heating apparatus which may be easy in operation and sequentially acts as a high frequency heating device and a steam heating device thus providing good taste of cooked food with a relatively short cooking time.

Another object of the invention is to provide a high frequency heating apparatus which comprises a control means for sequentially driving a high frequency generator and a steam generator to cause the heating apparatus to sequentially operate as a high frequency heating device and as a steam heating device.

Still another object of the invention is to provide a high frequency heating apparatus which includes an exhausting means for exhausting the hot air within said oven during the operation of said high frequency generator.

Generally, the present invention may be summarized as a high frequency heating apparatus comprising a steam generator, a high frequency generator and a control means for selectively providing a first operation mode for activating only the steam generator, a second operation mode for activating only the high frequency generator, and a third operation mode in which the steam generator is first activated and, after a given lapse of time, the high frequency generator is activated.

Other objects and features of the invention will be apparent from the following description taken in connection with the accompanying drawings, in which:

FIGS. 3A to 3C show a set of operation timing diagrams when the high frequency heating apparatus shown in FIG. 1 operates as a high frequency heating device;

FIGS. 4A to 4E show a set of operation timing diagram when the high frequency heating apparatus operates as a steam heating device;

FIGS. 5A to 5H show a set of operation timing diagrams when it first operates as the steam heating device and then as the high frequency heating device;

Figure 6:
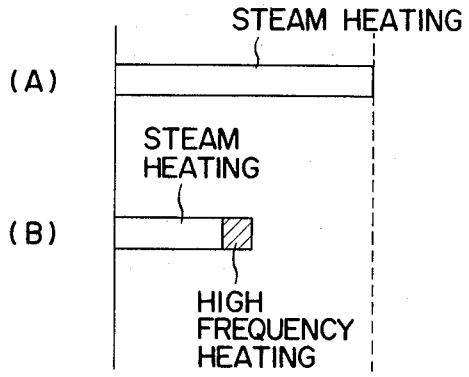
Figure 7:
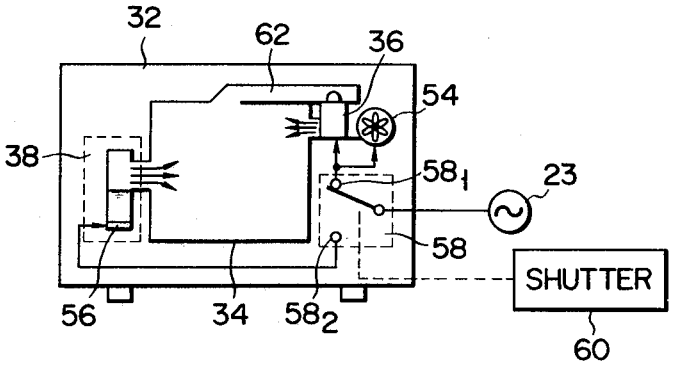
Figure 8:
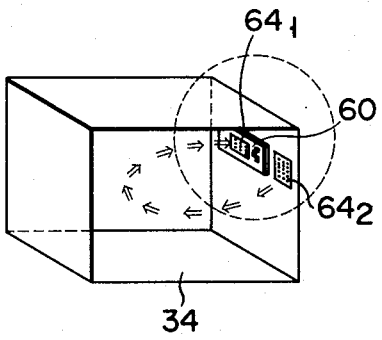
Figure 9:
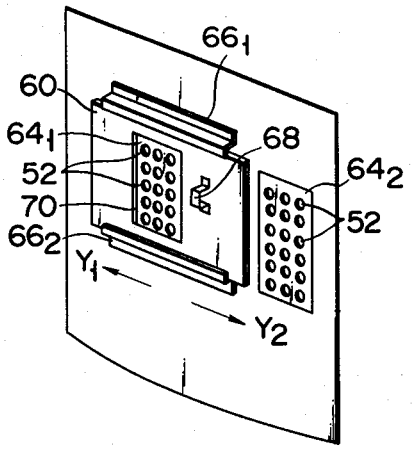

FIG. 6 comparatively shows cooking times by only the steam heating and by the combination of the high frequency heating and the steam heating;

FIG. 7 shows a schematic diagram of another embodiment of a high frequency heating apparatus according to the invention;

FIG. 8 shows perspective view of an oven used in the heating apparatus shown in FIG. 7; and FIG. 9 shows an enlarged view of a portion enclosed by a dotted line in FIG. 8.

Figure 1:
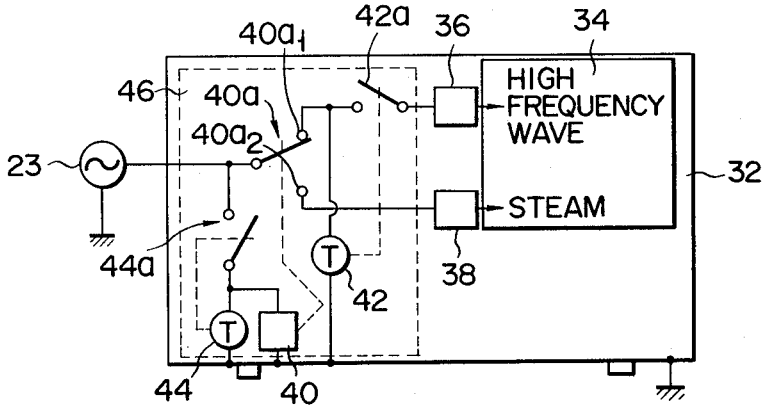
FIG. 1 shows a schematic circuit diagram of an embodiment of a high frequency heating apparatus according to the invention.

Reference is first made to FIG. 1 illustrating an embodiment of a high frequency heating apparatus according to the invention. Within a cabinet 32, there are disposed an oven 34, a steam generator 38 and a high frequency generator 36. The steam generator 38 and the high frequency generator 36 are connected to a relay contact 40*a* of a relay 40 (later described in detail). A movable contact of the relay contact 40*a* is connected to an AC power source 23. The relay contact 40*a* also includes two fixed contacts $40a_1$ and $40a_2$. The fixed contact $40a_1$ is connected to a contact 42*a* and then to the high frequency generator 36, and the fixed contact $40a_2$ is connected to the steam generator 38. The contact 42*a* interlocks with a timer 42. In a normal state of the heating apparatus, that is to say, a state that no power is supplied to the relay 40, the movable contact of the relay contact 40*a* is in contact with the fixed contact $40a_1$. Between the reference potential point (chassis potential point) and the relay contact 40*a* are connected a timer contact 44*a* operable interlocking with a timer 44 in this order. The relay 40 is connected to the timer 44 in parallel therewith. The relay 40, the relay contact 40*a*, the timer 42, the timer contact 42*a*, the timer 44, and the timer contact 44*a* cooperate to form a control circuit 46 for controlling the current feeding to the steam generator 38 and the high frequency generator 36.

Figure 2:
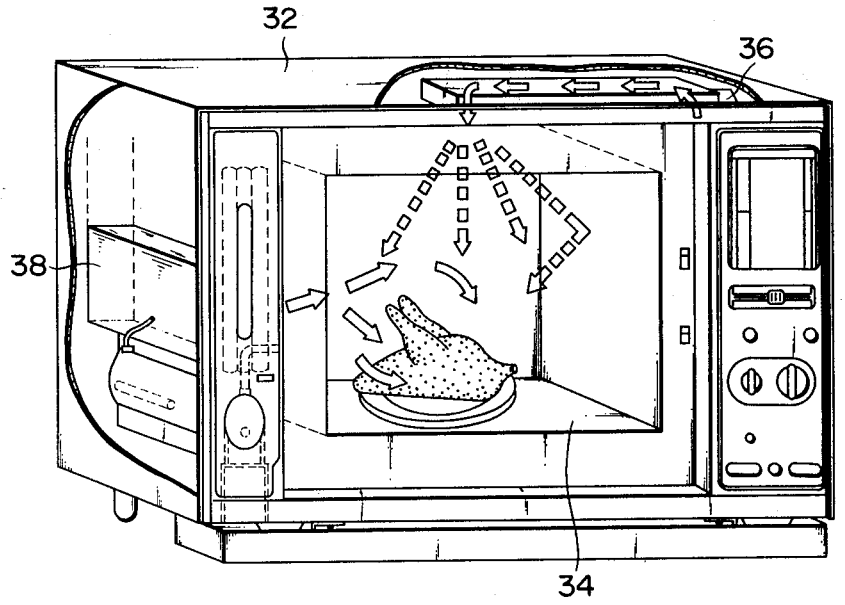
FIG. 2 shows an appearance view of the high frequency heating apparatus, partially broken away.

An appearance of the high frequency heating apparatus comprising such various components is shown in FIG. 2, partially broken away.

The operation of the high frequency heating apparatus will be explained first by reference to the operating mode in which the high frequency generator is driven to cause the heating apparatus to operate as a high frequency heating device, referring to FIGS. 3A to 3C illustrating a time chart.

In this case, a time period T desired for operating the high frequency generator 36 is set to close the contact 42*a*. The movable contact of the relay contact 40*a* is in contact with the fixed contact $40a_1$ in a normal state, that is, when the relay 40 is not energized. Accordingly, a current path including the power source 23, the relay contact 40*a*, the contact 42*a* and the high frequency generator 36 is formed so that the power source 23 supplies power to the high frequency generator 36. As a result, the high frequency wave is supplied to the oven 34 from time $t_1$. The radiated high frequency wave internally heats a foodstuff to be cooked placed on a dish within the oven 34. At time $t_2$, after the period T, the contact 42*a* is released so that the current feeding to the high frequency generator 36 is stopped and thus the heating apparatus ceases to operate as the high frequency heating device.

Secondly, reference will be made to the operating mode in which the high frequency heating apparatus is caused to operate as a steam heating device, in reference to FIGS. 4A to 4E illustrating a timing chart. The setting the timer to the time period T at time $t_1$ closes the contact 44*a* related to the timer 44. As a result, current is fed from the power source 23 to the timer 44 and also to the relay 40. Upon the energization of the relay 40, the movable contact of the relay contact 40*a* of the relay 40 is energized so that the movable contact is turned from the fixed contact $40a_1$ to the fixed contact $40a_2$, thereby to form a current path continuing from the power source 23 through the relay contact 40*a* to the steam generator 38. Although not shown in FIG. 1, a heater is provided as a heat source in the steam generator 38 and it is heated at time $t_1$ to heat the water in the tank to produce steam which in turn is supplied to the oven 34. Accordingly, the high frequency heating apparatus serves as a steam heating device to steam the foodstuff for cooking. After the lapse of time period T, i.e. at time $t_2$, the contact 44*a* is released to stop the current feeding to the relay 40 thereby to deenergize the relay 40. Accordingly, the movable contact of the relay contact 40*a* returns to the fixed contact $40a_1$, with the result that the current feeding to the steam generator 38 is made in operative to cause the high frequency heating apparatus to cease to function as a steam heating device.

Thirdly, reference will be made to the operating mode in which the high frequency heating apparatus first operates as a steam heating device and then operates as a high frequency heating device. Reference is made to FIGS. 5A to 5H illustrating a time chart relating to the operation. In this case, the timer 44 is set to a desired time period T1 for the steam generator 38 operation and the timer 42 is set to a desired time period T2 for the high frequency generator 36 operation when at time $t_1$, the time periods T1 and T2 are set in the timers 42 and 44, the timer contact 42*a* is closed and the timer contact 44*a* also is closed. The close of the timer contact 44*a* forms a current path from the power source 23 to the relay 40 thereby to energize the relay 40. As a result, the movable contact of the relay contact 40*a* is turned from the fixed contact $40a_1$ to another fixed contact $40a_2$. The result is the formation of a current path continuing from the power source 23 through the relay contact 40*a* to the steam generator 38. Under this condition, the movable contact of the relay contact 40*a* is turned to the fixed contact $40a_2$ shut off the power supply to the high frequency generator 36. In this way, during the time period T1 set by the timer 44, power is continuously supplied to the steam generator 38 and hence the heating apparatus operates as the steam heating device.

After the lapse of the time period T1, i.e. at the time t2, the contact 44*a* is released so that the current path to the relay 40 is cut off to deenergize the relay 40. For this, the movable contact of the relay contact 40*a* returns to the fixed contact $40a_1$. As previously stated, the timer 44 was set to the time T2 desired for driving the high frequency generator 36. Accordingly, at time $t_2$, the contact 42*a* is still kept in closed state. Therefore, the return of the movable contact of the relay contact 40*a* to the fixed contact $40a_1$ cuts off the current path to the steam generator 38, while at the same time forms the current path to the high frequency generator 36. Accordingly, high frequency wave is supplied into the oven 34. At this time, the high frequency heating apparatus operates as a high frequency heating device.

At time $t_3$, that the set operating time of the high frequency operator 36 has elapsed, the contact 42*a* is released to stop the power feeding to the high frequency generator 36. As a result, the heating apparatus is ceased to operate as a high frequency heating device.

As described above, the high frequency heating apparatus according to the invention is operable as a sole high frequency heating device or a sole steam heating device, and further is operable in the combination of the high frequency and the steam heating device by merely setting the two timers 42 and 44 in which it first operates as a steam heating device and, after a given time period, operates as a high frequency heating device. The heating apparatus with such a multi-function may be operated manually in a simple manner, and is operable with high reliability.

The inventor conducted a comparative experiment in which foodstuff was cooked by using only the steam and another foodstuff was cooked by using first the steam and then the high frequency wave. The result of the experiment showed that the steam and high frequency wave combined cooking takes half the time taken for the steam cooking. This is well illustrated in FIG. 6. In the figure, (A) indicates a cooking time when the foodstuff is cooked by only the steam and (B) a cooking time when it is cooked by the combination of steam and high frequency wave. As seen, in the case of (B), the cooking time is very short so that an amount of water extracted from the foodstuff is negligible. The cooking method indicated by the (B) is also effective when it is applied to the defreezing frozen foodstuff, and reheating the foodstuff once defrozen. Also in this case, the cooking time is shortened to be half of the time when it is processed by the method (A). The cookings suitable for the (B) method are, for example, steamed potatoes, baked chicken and steamed bread.

When the high frequency heating apparatus is used as the steam heating device, the oven 34 must be airtightly closed for improving the steam efficiency. On the other hand, when it is used as the high frequency heating device, steam produced in the oven 34 must be exhausted by a suitable means such as a ventilation opening, in order to prevent the windowpane from being clouded with steam.

The construction of the heating apparatus shown in FIG. 7 satisfies such a requirement. As shown, a cabinet 32 accommodates an oven 34 and a high frequency generator 36 and a steam generator 38, those later components being provided on one of the side walls of the oven 34. The same side wall has two groups of ventilation openings 52, as partly shown in FIGS. 8 and 9. In connection those openings, a fan 54 is provided near the openings 54 on the outside of the oven 34. A switch 58 is used to selectively supply electric power to the high frequency generator 36 and the fan 54 or the steam generator 38 and the heater 56. The switch 58 includes a movable contact connecting to a power source 23, a fixed contact $58_1$ connecting to the high frequency generator 36 and the fan 54, and another fixed contact connecting to the heater 56 of the steam generator 38. The switch 58 operates interlocking with a shutter 60 which will be described in detail referring to FIG. 9. A wave guide 62 guides high frequency waves generated from the high frequency generator 36 into the oven 34.

As shown in FIG. 8 illustrating the oven 34, two ventilation opening blocks $64_1$ and $64_2$ each having an arrangement of the ventilation opening 52 are formed in the side wall of the oven 34 where the high frequency generator 36 (not shown in FIG. 8) is disposed. A pair of guides $66_1$ and $66_2$ are provided on the side wall so as to guide the shutter 60 therealong. Each guide has an L-shaped cross section for forming a groove to slidably accept one end of the shutter 60. The shutter 60 manually slides along the guides $66_1$ and $66_2$ in a direction $Y_1$ or $Y_2$ and is provided with a knob 68 for this manual operation. Although not shown, the switch 58 is operated with relation to the sliding of the shutter 60 in the $Y_1$ or $Y_2$ direction. When shutter moves in the $Y_1$ direction, the movable contact of the switch 58 is turned to the fixed contact $58_1$ to form a power feeding path continuous to the high frequency generator 36 and the fan 54. Accordingly, the heating apparatus operates as the high frequency heating device. The fan 54 may be provided near the ventilation opening block $64_1$ and $64_2$. Further, a blower may be provided for one ventilation opening block while an air suction fan for the other ventilation opening block.

When the shutter 60 is moved in the direction $Y_2$, the movable contact of the switch 58 is switched to the fixed contact $58_2$ thereby to form a power feeding path to the steam generator (38). Accordingly, the heating apparatus operates in the steam heating mode.

As shown, the shutter 60 has an opening 70 which has a configuration so as to permit air flow through each ventilation opening arrangement $64_1$ and $64_2$. When the shutter 60 is fully moved in the $Y_1$ direction, the opening 70 provides an air path for the air flow through the ventilation opening block $64_1$. Under this condition, air through the ventilation opening block $64_2$ also freely flows therethrough. On the other hand, when it is fully moved in the $Y_2$ direction, the remaining part of the shutter 60 shuts off the air flows through the ventilation opening blocks $64_1$ and $64_2$.

The operation of the high frequency heating apparatus thus constructed will be described. When the apparatus is used as the steam heating device, the shutter 60 is manually moved in the $Y_1$ direction, along the guides $66_1$ and $66_2$, so that the movable contact of the switch 58 is turned to the fixed contact $58_1$ to form a power supply path continuing from the power source 23 to the high frequency generator 36 and the fan 54. Accordingly, the high frequency generator 36 supplies high frequency wave into the oven 34 through the wave guide 62. At this time, the fan 54 simultaneously starts to rotate. Under this condition where the shutter 60 is fully moved in the $Y_1$ direction, the opening 70 of the shutter is positioned to coincide with the ventilation opening block $64_1$. The other ventilation opening block $64_2$ is not shutted by the shutter 60 so that the air flow therethrough is freely permitted. The air blown by the fan 54 is fed into the oven 34 through the ventilation opening block $64_2$ and the air fed in the oven 34 is exhausted through the ventilation opening block $64_1$ to exterior, as shown by arrows in FIG. 8. In this manner, steam produced in the oven 34 is exhausted to exterior thereby to prevent the cloud of the windowpane by the steam.

When the high frequency heating apparatus is used as the steam heating device, the shutter 60 is moved fully to the side indicated by the arrow $Y_1$. Such a movement of the shutter 60 shuts the ventilation opening block $64_1$ and also the ventilation opening block $64_2$, so that the oven 34 is completely closed. At the time that the shutter 60 is fully moved in the $Y_1$ direction, the movable contact of the switch 58 is switched to the fixed contact $58_1$ so that a power feeding path from the power source 23 to the heater 56 of the steam generator 38 is formed and hence the steam is supplied from the steam generator 38 into the oven 34. Accordingly, the heating apparatus operates as the steam heating device.

As described above, the embodiment shown in FIGS. 7 to 9 is capable of exhausting steam through the ventilation opening blocks $64_1$ and $64_2$ in the high frequency heating device, while capable of airtightly closing the oven 34 by shutting the ventilation opening blocks $64_1$ and $64_2$ by means of the shutter in the steam heating mode. Therefore the functions of the steam heating and of the high frequency heating are considerably improved.

What is claimed is:

1. A microwave heating apparatus comprising:
a housing;
an oven disposed in the housing to receive a foodstuff to be cooked;
an A.C. power source;
a steam generator provided in the housing for supplying steam into the oven;
a microwave generator provided in the housing for radiating microwave energy into the oven; and
control means provided in the housing for controlling the operation of the steam and microwave generators in a user-selected one of three (3) modes (a), (b), and (c) of operation: (a) a first mode wherein only the steam generator is operated, (b) a second mode wherein only the microwave generator is operated, and (c) a third mode wherein the steam generator and the microwave generator are operated sequentially alternatingly, said control means including a first timer for setting an energization period of time for said steam generator, a second timer for setting an energization period of time for said microwave generator, an on-off switch which is turned on when said second timer is enabled, and a transfer switch connecting said A.C. power source to said steam generator when said first timer is enabled and connecting said A.C. power source to said on-off switch when the first timer is disabled.

2. A high frequency heating apparatus according to claim 1 further including an exhausting means for exhausting the hot air within said oven during the operation of said high frequency generator and preventing the exhausting of the oven during the operation of said steam generator.

3. A high frequency heating apparatus according to claim 2 wherein said exhausting means includes a blowing means provided in said housing and a ventilation opening formed through the wall of said oven to exhaust the hot air within said oven outwardly of the oven.

4. A high frequency heating apparatus according to claim 3 wherein said exhausting means further includes a shutter means which so functions as to open said ventilation opening during the operation of said high frequency generator and to close said ventilation opening during the operation of said steam generator.

5. A microwave heating apparatus according to claim 1 wherein the steam generator is provided on a side wall of the oven.

* * * * *